United States Patent [19]

Ubl

[11] Patent Number: 4,989,864

[45] Date of Patent: Feb. 5, 1991

[54] RACQUET STRING STRAIGHTENER

[76] Inventor: Vaclay Ubl, 5 Winona Road, Mount Eliza, 3930, Victoria, Australia

[21] Appl. No.: 156,634

[22] Filed: Feb. 17, 1988

[30] Foreign Application Priority Data

Jan. 27, 1988 [AU] Australia ..... PI6428

[51] Int. Cl.[5] ..... A63B 49/00

[52] U.S. Cl. ..... 273/73 D; 273/73 R

[58] Field of Search ..... 273/73 R, 73 D, 73

[56] References Cited

U.S. PATENT DOCUMENTS 4,089,523 5/1978 Newburger et al. ..... 273/73 R 4,489,942 12/1984 Kent ..... 273/73 R 4,733,866 3/1988 Herbert ..... 273/73 R

*Primary Examiner*—Randall L. Green

*Assistant Examiner*—Gary Jackson

*Attorney, Agent, or Firm*—Harness, Dickey & Pierce

[57] ABSTRACT

The racquet string straightening device comprises a support from one face of which a fixed array of teeth project. The teeth are arranged in rows with passages therebetween to receive the strings of a racquet and in a second embodiment alternate teeth may be omitted. Each tooth has a body of rectangular cross-section defined by pairs of parallel sides and a tapered outer end to facilitate entry of the tooth into the respective opening in the strings.

9 Claims, 3 Drawing Sheets

FIG 2
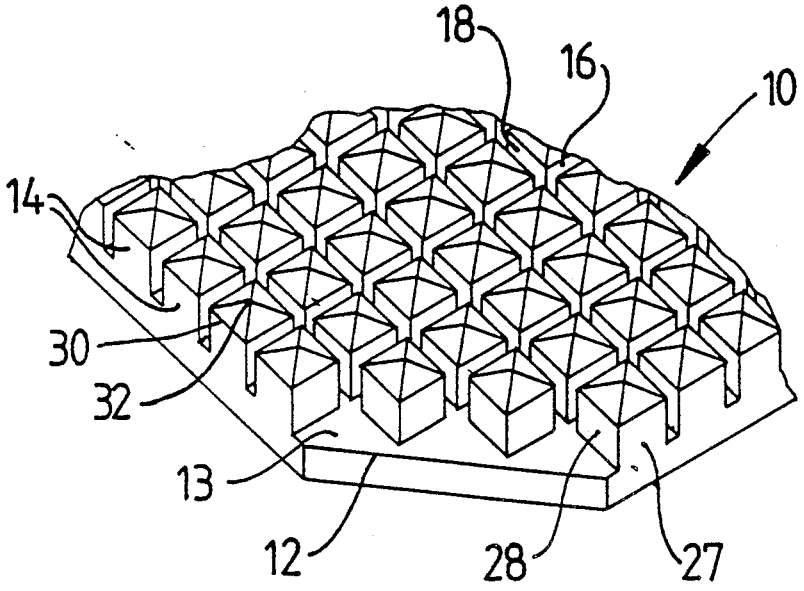
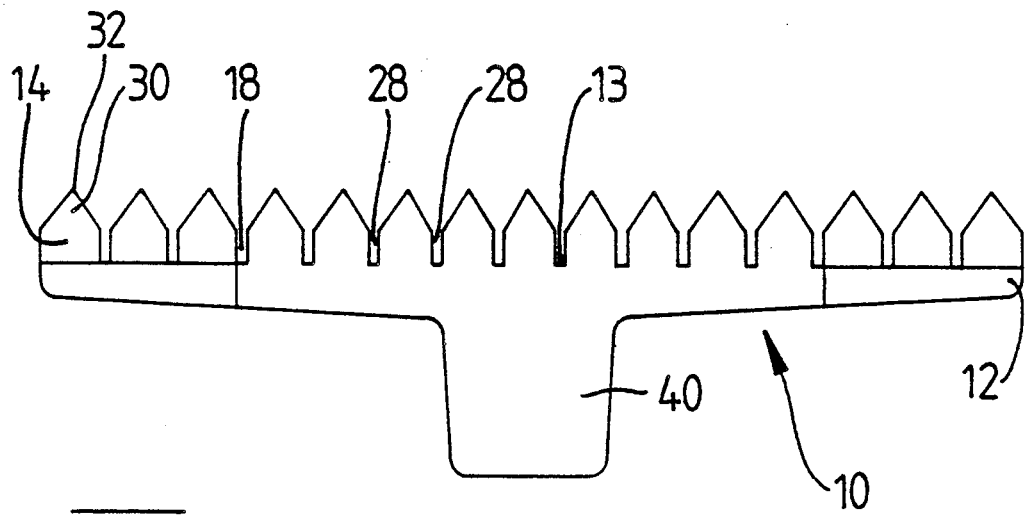
FIG 3

RACQUET STRING STRAIGHTENER

BACKGROUND OF THE INVENTION

This invention relates to stringed sports racquets, and is particularly concerned with a device for straightening the strings of an already strung and tensioned racquet, for example so that they extend in an appropriate orthogonal arrangement.

Many sports, such as tennis, squash and badminton use stringed racquets to hit a ball in the course of a game. The racquet typically has an elongated handle surmounted by a head which has a stringed planar surface adapted to hit the ball. Generally the head comprises a substantially circular or ovoid frame of wood or metal which supports an orthogonal array of interwoven, tensioned strings. Each opening between adjacent strings in the array is frequently a rectangle having sides of approximately 1 cm, but some variation in size and shape of such openings occurs between different sizes of racquets, i.e. as used for squash and tennis, and between strings close to the frame as compared to the centre of the array.

During play any one string tends to become displaced from its normal linear position in the array, as the strings come into frequent and often violent contact with the ball. The effects of displaced strings are numerous. For instance strings may be displaced away from particular regions of the head resulting in an area which imparts a diminished impetus to the ball. Further an area with an excessive or inadequate number of strings due to string displacement may not return the ball in a predictable trajectory.

In the past, players of racquet sports have attempted to straighten displaced strings with their fingers. This method is time consuming and may not return all the strings to their correct position. Furthermore the strings tend to collect body oils and dirt from the player's fingers which may act to abrade and degrade the strings, particularly catgut strings.

British Pat. Specification No. 8,600,316 describes a racquet string straightener having a movable row of teeth, each tooth having a complicated set of notches at its outer end. To use the device of this specification the teeth are manually adjusted to an appropriate distance along the length of the device to receive respective cross-wise strings. When a single lengthwise string is pressed into the notches of the row of teeth, at that string is straightened. As can be seen the device of this British Specification requires a certain amount of manual dexterity to use and in any case can only straighten a single string at any one time.

It is an object of the present invention to ameliorate the difficulties faced by racquet sport players by providing a device which may simply and quickly restore at least several of the strings of a racquet to their correct array.

SUMMARY OF THE INVENTION

In accordance with the present invention there is provided a racquet string straightening device comprising a support and a fixed array of teeth projecting from the support which have sides and an outer end and are each shaped so as to be capable of being closely received within a respective opening defined in the orthogonal array of strings of a racquet, the teeth being disposed relative to each other so as to be capable of each receiving a portion of a respective string alongside each side thereof.

In use, the head of a racquet is pressed into the device such that the array of teeth, or part of the array, projects through respective openings between the strings of the racquet. The sides of the teeth guide the respective portions of the adjacent strings to their correct position within the orthogonal array of strings.

Conveniently, the outer ends of the teeth remote from the support are shaped to facilitate entry of the teeth into the openings. The individual teeth may be tapered from the outer end to a broader base, which base will generally have a cross-section which is rectangular or square according to the associated opening in the array of strings. Alternatively the sides of each tooth may form a body of constant cross-section in which case the outer end thereof may be tapered to facilitate entry into the associated opening in the array of strings when one or more of the strings is substantially displaced. This joint between the constant cross-section body and the tapered outer end may be advantageously smoothed so as to facilitate displacement of the strings over the joint. The teeth may be solid or hollow and in the latter instance may have one side or even two opposed sides omitted, or parts of the sides may be omitted.

As noted already, the openings in the array of strings of most racquets tend to vary in shape and size from the centre of the array to adjacent the frame and the fixed array of teeth should be disposed relative to each other and be shaped to suit the particular orthogonal array of strings of the racquet for which the device is intended. In particular the teeth adapted to be received by openings between strings close to the frame will typically have a rectangular cross-section at least at the base while those adapted to be received between strings at the centre of the array will generally be square. The size, shape and position relative to each other of the teeth may also vary for different kinds of racquets such as for tennis or squash, or for racquets having different stringing methods and patterns.

The fixed array of teeth may be such that the teeth are adapted to be received in adjacent openings between the strings of a racquet, so that adjacent teeth have a groove therebetween to receive the portion of a respective string therein. Alternatively some teeth may be omitted to produce a spaced array of teeth projecting from the support. It is preferred that the spaced array of teeth is such as to have teeth received by at least every second opening between strings so that alternate teeth are omitted and the spaced array has a checkerboard appearance.

The fixed array of teeth will generally extend over an area of somewhat smaller than the area of the head of the racquet for which the device is adapted. The array of teeth may be rectangular, oval or, for example, circular, and preferably covers a sufficient area of the racquet head for which it is designed to straighten the strings in at least the "sweet spot". Alternatively, the device may be relatively small and need to be applied several times to different areas of the racquet head to straighten substantially all of the strings of the array.

Most advantageously, the teeth of the array project from the support perpendicular to a single plane. Thus, the support may be planar and the single plane is defined by the principal plane of the support.

Alternatively the support may define a curved surface, for example arcuate, about one or more axes, and each tooth projects substantially perpendicularly from the associated portion of the support surface. This embodiment will typically be used by inserting the teeth at one edge of the device into openings at a corresponding portion of the array of strings and rolling the device so that the remaining teeth are successively inserted into respective openings between the strings as the inserted teeth are withdrawn.

The device of the present invention may be provided with a handle or other gripping means on the opposite side of the support to the array of teeth to aid in its manipulation. Alternatively the device may be mounted on a structure such as a post or wall.

BRIEF DESCRIPTION OF THE DRAWINGS

Two embodiments of a racquet string straightening device in accordance with the present invention will now be described by way of example only with reference to the accompanying drawings in which:

FIG. 2 is a perspective view of a portion of the embodiment of FIG. 1;

FIG. 3 is a side view of the embodiment of FIG. 1; and

DETAILED DESCRIPTION OF THE PREFERRED EMBODIMENTS OF THE INVENTION

Figure 1:
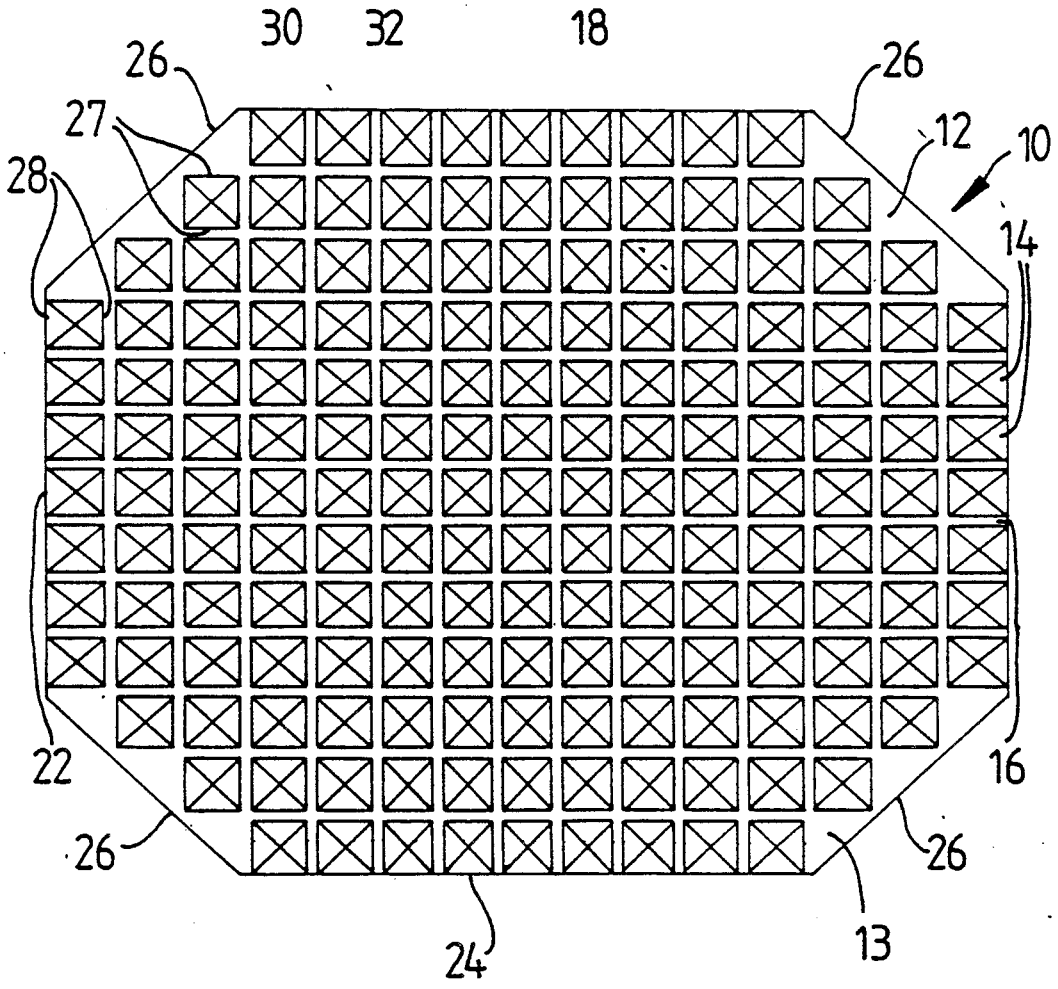
FIG. 1 is a plan view of the device showing the orthogonal array of teeth.

Referring to FIGS. 1 to 3, the racquet string straightening device 10 comprises a planar support 12 having a front face 13 from which projects an orthogonal array of teeth 14, said array defining a plurality of intersecting linear passages 16 and 18 extending respectively longitudinally and transversely of the front face between immediately adjacent rows of the teeth. Passages 16 and 18 have a width marginally larger than the cross-section of a racquet string.

The front face 13 of support 12 defines a planar octagon having opposed longitudinal sides 24, opposed lateral sides 22 and four diagonal sides 26 extending between the sides 22 and 24, and thus approximates the oval shape of a tennis racquet head.

The teeth 14 each have pairs 27 and 28 of parallel sides so as to define a rectangular cross-section, and have an outer end 30 remote from the support 12. Each outer end 30 is in the shape of a pyramid so that each tooth tapers to a point 32 so as to facilitate entry of the teeth into the respective openings in the array of strings, particularly where the strings are severely displaced, and the joint between the outer end 30 and the constant cross-section portion is preferably smoothed or rounded off rather than a sharp delineation.

The teeth 14 towards the centre of the array of teeth have a square cross-section, whereas the teeth disposed adjacent sides 22 of the support have a rectangular cross-section with the shorter sides thereof parallel to the sides 24. The teeth between these extremes have a gradually elongated cross-section with increasing distance from the centre portion of the array of teeth. This variation in shape of the teeth corresponds to a common variation in the shape of the openings in the array of strings on a racquet so that the described device 10 is adapted to be used centrally of the frame of the racquet. Clearly other shapes or variations of shape of the teeth may be adopted for different stringing arrangements.

As can be seen in FIG. 3, a handle 40 is provided on the side of the device remote from the front face 13 to facilitate use of the device. The handle may be in the form of a knob or a rib that extends the full length or width of the support 12. If the handle does not have any undercuts injection moulding may be facilitated.

The device 10 is preferably formed by injection moulding in suitable thermoplastics material and may be solid. Alternatively, the support and/or teeth may be hollow. Clearly, the device 10 may be formed in other suitable material such as wood.

In use, the device 10 and head of a racquet (not shown) are relatively pressed onto each other with passages 16 parallel to the handle of the racquet. The outer ends 30 of the teeth 14 are received in respective openings between the strings of the racquet notwithstanding that the strings may be displaced. As the teeth are pressed further through the openings between the strings, the tapered outer ends 30 guide the strings until they enter passages 16 and 18 so that the strings are straightened to a regular orthogonal array.

Figure 4:
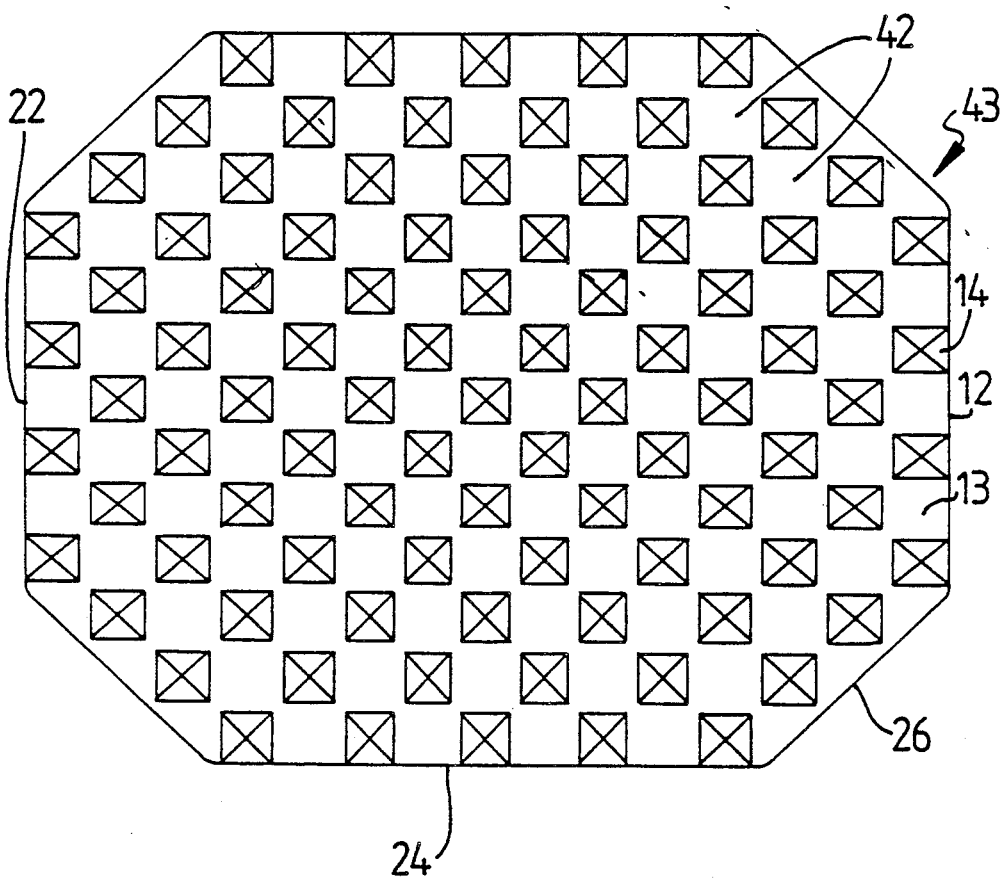
FIG. 4 is a view similar to FIG. 1 but showing a second embodiment of the device.

FIG. 4 shows a plan view of a second embodiment of the invention, in which the device 43 is very similar to the device 10 of FIGS. 1 to 3. Accordingly, the same reference numerals will be used for the same or similar parts, and the device 43 will only be described in relation to the differences from the device 10.

The sole difference is that in the device 43 every other tooth 14 is omitted so that the front face 13 has a checkerboard appearance in plan view and the passages 16 and 18 are omitted since no tooth has an immediately adjacent tooth. Thus there are spaces 42 between adjacent teeth in any one row but the immediately adjacent rows remain spaced to the same extent of passages 16 and 18 so as to receive the strings of a racquet therebetween. The spacing of the teeth in this manner is not believed to effect the effectiveness of the device 43 in straightening the strings.

It will be appreciated that many modifications and variations may be made to the described embodiments and all such modifications and variations should be construed as within the scope of the present invention.

I claim:

1. A racquet string straightener device comprising a support and an array of teeth fixed to and projecting from the support, each of said teeth having a base of a shape to be received in engagement with a respective opening formed by an orthogonal arrays of strings of a racquet and in engagement with the strings and an outer end of reduced size to facilitate insertion into the opening, said teeth being disposed relative to each other in rows to define therebetween a first plurality of parallel gaps and a second plurality of parallel gaps extending perpendicular to said first plurality of gaps, said gaps being of a width only slightly larger than the width of said strings to each receive a portion of a respective string therein to reform a displaced string back into its original configuration by interaction between the displaced string and adjacent rows of teeth, being aligned in rows that extend parallel to said gaps the spacing between adjacent teeth of said rows being greater than the width of said gaps.

2. A device according to claim 1 wherein the outer end of each tooth is tapered in the shape of a pyramid.

3. A device according to claim 1 wherein each tooth has a body portion between the outer end and the base, said body portion having a profile of substantially constant cross-section.

4. A device according to claim 1 wherein the support has a front face from which the teeth project which is planar.

5. A device according to claim 1 wherein each tooth projects perpendicularly from support.

6. A device according to claim 1 which is provided with a handle.

7. A device as set forth in claim 1 wherein the spacing between the teeth is such that the teeth form a checkerboard pattern when viewed in plan.

8. A racquet string straightener device comprising a support and an array of teeth fixed to and projecting from the support, each of said teeth having a base of a shape to be received in engagement with a respective opening formed by an orthogonal arrays of strings of a racquet and in engagement with the strings and an outer end of reduced size to facilitate insertion into the opening, said teeth being disposed relative to each other in rows to define therebetween a first plurality of parallel gaps and a second plurality of parallel gaps extending perpendicular to said first plurality of gaps, said gaps being of a width only slightly larger than the width of said strings to each receive a portion of a respective string therein to reform a displaced string back into its original configuration by interaction between the displaced string and adjacent rows of teeth, said teeth being spaced such that the teeth are adapted to be received by alternate openings between the strings with no teeth being received in the remaining openings.

9. A racquet string straightener device comprising a support and an array of teeth fixed to and projecting from the support, each of said teeth having a base of a shape to be received in engagement with a respective opening formed by an orthogonal arrays of strings of a racquet and in engagement with the strings and an outer end of reduced size to facilitate insertion into the opening, said teeth being disposed relative to each other in rows to define therebetween a first plurality of parallel gaps and a second plurality of parallel gaps extending perpendicular to said first plurality of gaps, said gaps being of a width only slightly larger than the width of said strings to each receive a portion of a respective string therein to reform a displaced string back into its original configuration by interaction between the displaced string and adjacent rows of teeth, the teeth located centrally of said support have their bases of square cross section and those at at least some peripheral edges of the support are not square.

* * * * *